US008857366B2

(12) United States Patent
Russikoff

(10) Patent No.: US 8,857,366 B2
(45) Date of Patent: Oct. 14, 2014

(54) MANUALLY-OPERATED BOAT CANOPY SYSTEM

(76) Inventor: Ronald K. Russikoff, Philadelphia, PA (US)

( * ) Notice: Subject to any disclaimer, the term of this patent is extended or adjusted under 35 U.S.C. 154(b) by 203 days.

(21) Appl. No.: 13/134,057

(22) Filed: May 27, 2011

(65) Prior Publication Data

US 2011/0290170 A1 Dec. 1, 2011

Related U.S. Application Data

(60) Provisional application No. 61/396,569, filed on May 28, 2010.

(51) Int. Cl.
*B63B 17/00* (2006.01)
*B63B 17/02* (2006.01)

(52) U.S. Cl.
CPC ..... *B63B 17/02* (2013.01); *B63B 2221/24* (2013.01)
USPC ..... 114/361

(58) Field of Classification Search
CPC .. B63B 17/02; B63B 17/00; B63B 2017/026; B63B 19/00; B63B 59/02; B60J 3/002; B60J 3/0208; B60J 1/2011; B60J 3/0278; B60J 7/047; B60J 1/2027; B60J 1/208; B60J 1/2044; B60J 1/2033; E06B 9/40; E06B 9/78
USPC ..... 114/361; 296/99.1, 95.1, 97.1, 216.01; 160/370.22
See application file for complete search history.

(56) References Cited

U.S. PATENT DOCUMENTS

| | | | | |
|---|---|---|---|---|
| 5,353,826 | A * | 10/1994 | Davis, Sr. | 135/88.13 |
| 6,439,150 | B1 * | 8/2002 | Murphy et al. | 114/361 |
| 7,093,558 | B1 * | 8/2006 | Mandanici | 114/361 |
| 7,395,774 | B2 * | 7/2008 | Borges et al. | 114/361 |
| 7,571,691 | B2 * | 8/2009 | Russikoff | 114/361 |
| 7,895,964 | B2 * | 3/2011 | Russikoff | 114/361 |

* cited by examiner

*Primary Examiner* — Lara A Olson
*Assistant Examiner* — Anthony Wiest
(74) *Attorney, Agent, or Firm* — Armand M. Vozzo, Jr.

(57) ABSTRACT

A manually-operated canopy deployment system for mounted attachment onboard recreational boats comprises a pair of spring-loaded tubular actuators telescopically assembled and coupled in parallel alignment to deploy a flexible canvas from a roller member transversely mounted between the actuators with a gear box operatively connected to the roller member to control the canvas deployment. Each actuator assembly includes a rearward outer tube, and separate forward and intermediate interior tubes each fitted with inner end caps and coaxially disposed to move longitudinally within the outer tube, with compression springs separately disposed within the respective tube chambers to apply outbound forces axially upon the inner ends of the respective interior tubes. Forward and intermediate cross bars connected across the interior tubes serve to draw the canvas from the roller member and support canvas deployment, with a pair of loop attachments provided on the surface of the canvas to prevent billowing thereof.

14 Claims, 6 Drawing Sheets

MANUALLY-OPERATED BOAT CANOPY SYSTEM

CROSS-REFERENCE TO RELATED APPLICATION

This application is a continuation-in-part of provisional patent application Ser. No. 61/396,569 filed May 28, 2010 for Manually-Operated Boat Canopy System.

BACKGROUND OF THE INVENTION

The present invention relates to retractable canopy systems for boats, and more particularly to an improved manually-operated canopy deployment system wherein a pair of spring-loaded telescoping tubular actuators are assembled and connected in parallel alignment within a self-supporting framework to deploy a flexible canvas with a gear box to control the telescopic movement of the actuators and provide lightweight and readily mountable sunshade protection on a variety of boat structures.

In recreational boating, the so-called "bimini top" is a convertible cover erected upon the deck of the boat and made to be deployed at an elevation comfortably above the heads of the passengers. Drawing its name from the Bimini islands in the Bahamas where it was first employed by boaters to provide desired shade from the strong rays of the tropical sun, the standard type of bimini top and those convertible boat covers of the same nature generally comprise a flexible canvas material secured to a foldable support frame that is erected across the deck and pivotally attached thereto. These standard types of foldable bimini tops can be raised when needed or lowered into a substantially flat position upon the deck when not in use or when an overhead obstruction may otherwise require its lowering. While deployment of these folding type bimini tops was often done manually, some were designed to be automated in their operation, the latter requiring electrical power, such as those described in U.S. Pat. Nos. 6,209,477 to Briedenweg and 6,983,716 to Ankney et al. Regardless of their specific foldable structure or method of operational deployment, the installation and utilization of bimini tops have became increasingly important for the protection of passengers and crew on board boats against excessive sun exposure and the known risks of skin cancer caused thereby.

While providing effective sunshade protection, the assembled structure of these folding bimini top arrangements, typically including a plurality of poles or bow-like members pivotally mounted across the boat deck, would often obstruct a person on board from reaching out over the side of the boat when fishing, docking or mooring the boat and further present an obstacle in boarding and loading equipment onto the deck. To overcome these obstacles and still provide effective sunshade protection, retractable canopy systems were devised and developed as retrofits for recreational boats capable of operative attachment to existing overhead structure on the boat without causing obstructions upon the deck. As retrofits, such retractable canopy systems were designed to mount onto existing rooftop members set over the deck of a boat or upon other elevated structures, such as radar arches or towers. These prior art retrofit canopy systems include those designed to be manually operated, such as those described in U.S. Pat. Nos. 4,951,594 to Feikama and 6,439,150 to Murphy et al., and those designed to be automated in their operation, such as that described in U.S. Pat. No. 7,571,691 to Russikoff. While these prior art canopy systems have been generally satisfactory in their intended manual or automated deployment upon boats, some drawbacks have arisen in their implementation and usage. The automated systems, for example, while providing relatively quick and easy deployment in a self-supporting framework, are rather burdensome in the weight of their assembled components, particularly those involved in their powered operation, and further in amount of retrofit labor involved in the mounting and routed connections these automated systems require. The manual systems, on the other hand, while being generally lighter in weight and more simple in their retrofit attachments than the automated systems, have been somewhat limited in their operational deployment upon existing rooftops of recreational boats and in providing extended sunshade protection therefrom in a relatively easy and efficient manner.

Accordingly, there is a need for a new and improved canopy deployment system for recreational boats that is self-supporting in its structure and easy to mount and implement on virtually any style boat so as to provide relatively quick and efficient sunshade protection whenever necessary. Furthermore, there is an associated need for such an improved canopy deployment system to be relatively inexpensive to construct and assemble and be affordable to a substantial number of boat owners.

SUMMARY OF THE INVENTION

Accordingly, it is a general purpose and object of the present invention to provide an improved canopy deployment system for boats that is simple to operate and easily retrofitted to existing boat structure for providing extended sunshade protection to those on board the boat without causing obstructions upon the deck.

A more particular object of the present invention is to provide an improved canopy deployment system for recreational boats that is lightweight and self-supporting in its assembled structure and readily mountable to existing rooftop structure on the boat to provide extended sunshade protection whenever needed and without presenting obstructions to the movement or performance of those on or around the deck.

Another object of the present invention is to provide an improved canopy deployment system for recreational boats that may be mounted upon the surface of an existing hardtop on the boat or fully integrated within the hardtop or bridge structure atop the deck to furnish retractable sunshade protection to persons on board the boat.

Still another object of the present invention is to provide an improved boat canopy deployment system that is safe and easy to use and suitable to fit virtually any style boat.

A further object of the present invention is to provide an improved boat canopy deployment system that is relatively inexpensive to manufacture and assemble in a working unit affordable to a substantial number of boat owners.

Briefly, these and other objects are accomplished by a manually-operated canopy deployment system for recreational boats designed for mounted attachment to existing rooftop structure. The present system comprises a pair of spring-loaded tubular actuators telescopically assembled and coupled in parallel alignment to deploy a flexible canvas from a roller member transversely mounted between the actuators with a gear box operatively connected to the roller member to control the canvas deployment. Each actuator assembly includes a rearward outer tube closed at its back end, separate forward and intermediate interior tubes each fitted with inner end caps and coaxially disposed to move longitudinally within the outer tube, and compression springs separately disposed within the respective chambers of the outer tube and intermediate interior tube to apply outbound forces axially upon the inner ends of the respective interior tubes. Sleeve members disposed between the respective tubes at their forward ends provide bearing surfaces that stabilize their telescoping movement. Forward and intermediate cross bars transversely mounted and connected across ends of the interior tubes serve to draw the canvas from the roller member and support canvas deployment, with a pair of loop attachments provided on the surface of the canvas to engage the intermediate cross bar upon full deployment of the canvas to prevent billowing.

For a better understanding of these and other aspects of the present invention, reference should be made to the following detailed description taken in conjunction with the accompanying drawings in which like reference numerals and character designate like parts throughout the figures thereof.

BRIEF DESCRIPTION OF THE DRAWINGS

For a fuller understanding of the nature and objects of the present invention, references in the detailed description set forth below shall be made to the accompanying drawings in which.

DETAILED DESCRIPTION OF THE INVENTION

Figure 1:
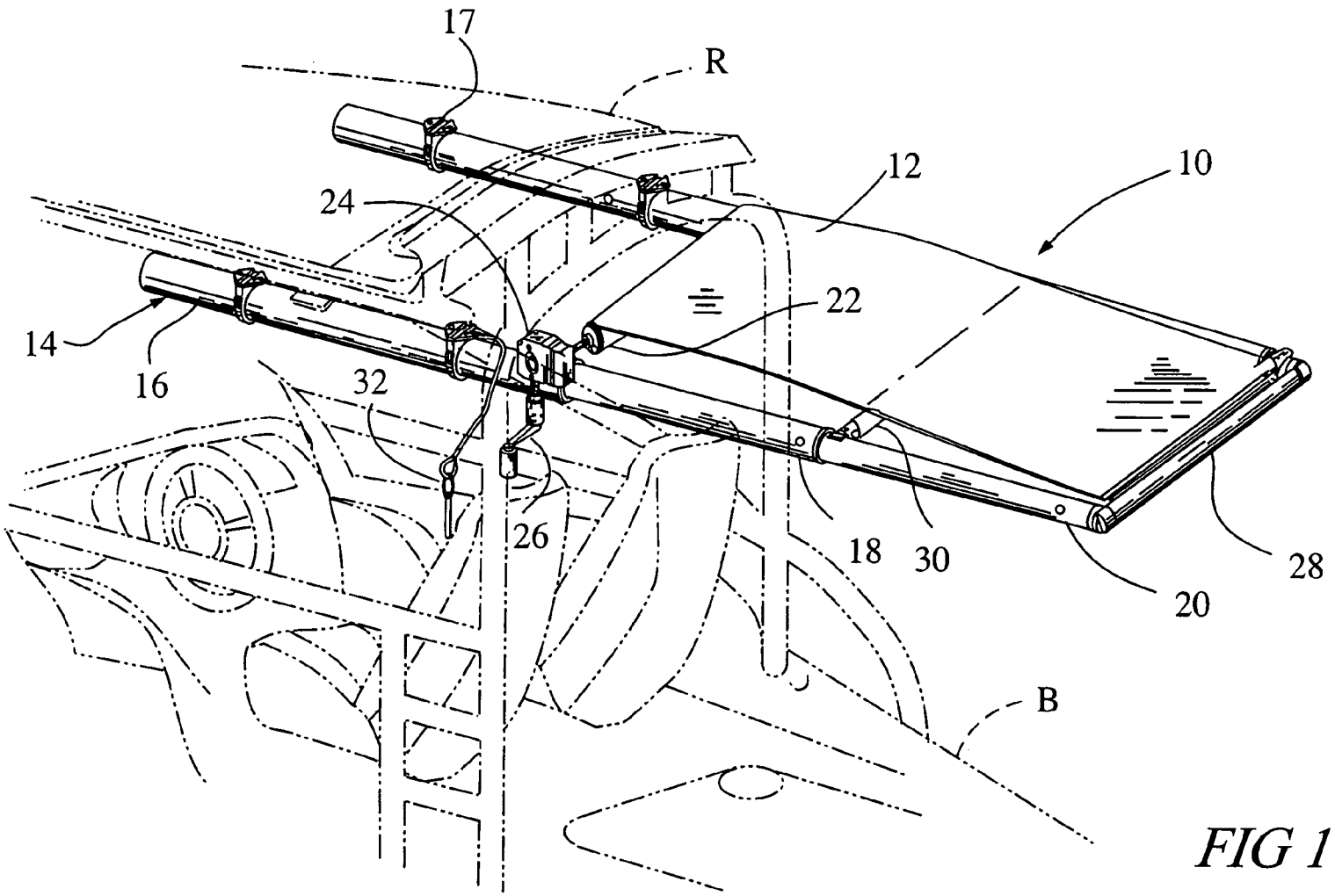
FIG. 1 is a perspective view of a recreational boat equipped with a canopy deployment system made in accordance with the present invention and shown in extended deployment from the rooftop structure on the boat.

The following is a detailed description of a preferred embodiment of the present invention and the best presently contemplated mode of its production and practice. This description is further made for the purpose of illustrating the general principles of the invention but should not be taken in a limiting sense, the scope of the invention being best determined by reference to the appended claims.

Referring to the drawings, the following is a list of structural elements of the present canopy deployment system, generally designated 10, and those associated elements shown employed in connection with the present invention:

10 canopy deployment system;
12 canvas;
14 tubular actuator assembly;
16 rearward outer tube;
16*a* rearward tube hole;
17 mounting clamps;
18 intermediate tube member;
18*a intermediate tube hole;*
20 forward tube member;
20*a forward tube hole;*
22 roller member;
23 roller shaft;
24 gear box;
26 handle;
28 forward crossbar;
30 intermediate crossbar;
31 tab members;
32 lock pin;
33 connector ring;
34 connector wire;
36 rearward compression spring;
38 rearward sleeve;
38*a* rearward sleeve hole;
38*b* end rim;
40 rearward end cap;
42 intermediate compression spring;
44 intermediate sleeve;
44*a* intermediate sleeve hole;
44*b* end rim;
46 intermediate end cap;
48 ring sleeve;
50 forward end cap;
52 strap fastener;
54 loop;
B recreational boat; and
R rooftop structure.

Referring now to FIG. 1, a preferred embodiment of the present canopy deployment system, generally designated 10, is shown in its extended deployment above the deck of a recreational boat B, the system being intended for operation in mounted attachment to a rigid canopy or other fixed rooftop structure R on the boat. Designed for improved manual operation and intended to provide additional sunshade protection for those on board the boat B, the present canopy deployment system 10 comprises a pair of spring-loaded tubular actuator assemblies 14 telescopically constructed and combined in parallel alignment to deploy a flexible canvas material 12 from upon a roller member 22 that is transversely mounted between the respective actuator assemblies. Each tubular actuator assembly 14 includes a rearward outer tube member 16 closed at its back end and a separate pair of interior tubes, one being an intermediate tube member 18 and the other being a forward tube member 20, each sized in their respective lengths and diameters to fit together telescopically in such a fashion that allows the forward tube member to slide longitudinally within the intermediate tube member and together with the intermediate tube member, to slide within the outer tube member. All rigid members of the canopy deployment system 10 including those of the tubular actuator assemblies. 14 are generally made of relatively strong and durable materials that are particularly resistant to corrosion, including metals, such as aluminum, aluminum alloys, and stainless steel and synthetic thermoplastics, such as nylon.

The rearward outer tube 16 is designed to be the stationary member in the tubular actuator assembly 14 and serves as the base for mounting the present canopy deployment system 10 upon the boat B. Mounting clamps 17, typically a pair for each tubular actuator assembly 14, are adapted to fit about and engage the circumference of the rearward outer tube 16 and provide a means for attaching the outer tube and associated structure of the actuator assembly to the rooftop structure R on port and starboard sides of the boat B using conventional mechanical fasteners. The rearward outer tubes 16 are mounted to the rooftop structure R substantially parallel to each other and positioned longitudinally on each side so that the roller member 22, transversely situated upon the canopy deployment system 10 at the front of the outer tube members, may be preferably set in close proximity alongside the rearward edge of the rooftop structure. The roller member 22 is secured upon and disposed for rotation along a roller shaft 23 that is rotatably mounted between the tubular actuator assemblies 14 near the front ends of the outer tube members 16. A manual gear box 24 equipped with a handle 26 for cranking operation is mounted upon the outer tube 16 on one side of the canopy deployment system 10 and operatively connected to the roller shaft 23 to control rotation of the roller member 22 in either direction. The gear box 24 is a mechanical unit of conventional design having a gear ratio, typically about 11:1, sufficient to facilitate the cranking of the canopy deployment system 10, particularly in the roll-up or retraction of the canvas material 12 upon roller member 22 against the spring forces applied within the actuator tube assemblies 14 as described below in greater detail.

The canvas material 12 is cut and finished in an extended sheet having a width intended to substantially span the space between the tubular actuator assemblies 14. One end of the canvas material 12 is fastened along its edge to the surface of the roller member 22, typically across the roller member surface using a conventional mechanical fastener, and the remaining length of the canvas material is wrapped around the roller member a sufficient number of times. The opposite or outside end of the canvas material 12 is adapted to releasably fasten along its edge to a forward crossbar 28 that is transversely connected between the actuator tube assemblies 14 at the front ends of the forward tube members 20. An intermediate coupling strip, such as a one incorporating zipper engagement, may be used to releasably fasten the outer edge of the canvas material 12 to the forward crossbar 28. As described below in greater detail, outward movement of the forward crossbar 28 upon the extended actuator tube assemblies 14 serves to draw the canvas material 12 from the roller member 22 and allows the full extension of the present canopy deployment system 10. An intermediate crossbar 30 transversely connected between the actuator tube assemblies 14 at the front ends of the intermediate tube member 18 is further provided on the present canopy deployment system 10 to support its extended structure and, as described below, further provide a means for holding the extended canvas material 12 in place and prevent it from billowing.

Figure 2:
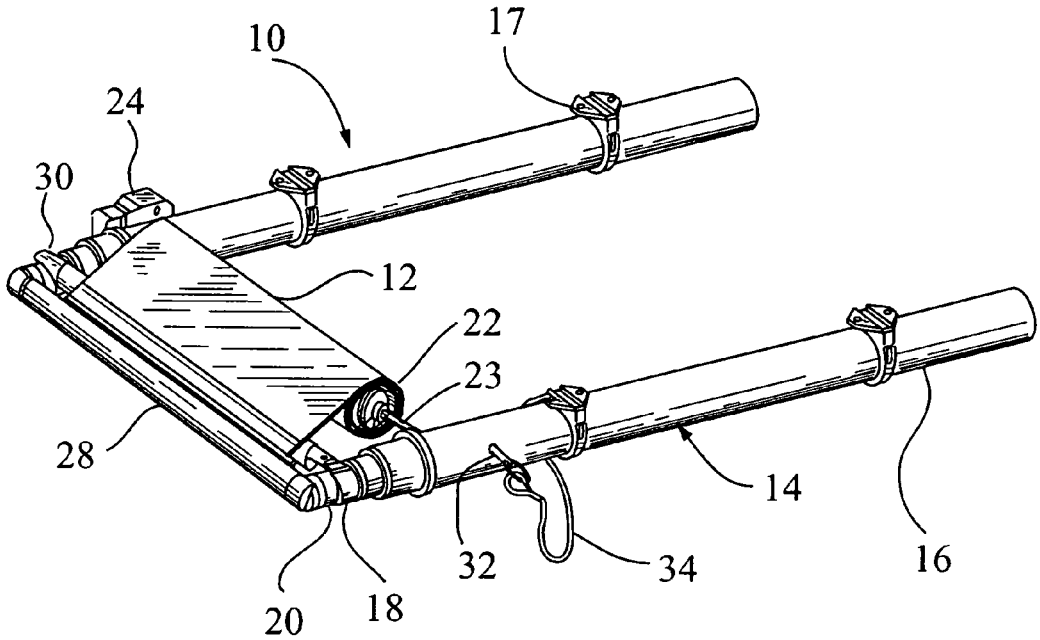
FIG. 2 is a perspective view of the canopy deployment system of FIG. 1 shown in a retracted state and separated from the rooftop structure of the boat.

Referring now to FIG. 2 in conjunction with FIG. 1, the present canopy deployment system 10 is drawn into its retracted state manually using the gear box 24 and its associated handle 26 to crank the roller shaft 23 in a reverse direction, and with the associated gear reduction provided by the gear box, transmit the rotation through to the roller member 22. This reverse rotation of the roller member 22 draws the extended canvas material 12 back and onto the roller member and in so doing, pulls the forward crossbar 28 as well as the forward tube members 20 on each side back toward the roller member, the forward tube members sliding telescopically back into the respective tube actuator assemblies 14 on each side. As the reverse rotation of the roller member 22 continues, the intermediate crossbar 30 and the intermediate tube members 18 attached thereto are pulled back together with the forward crossbar 28 and forward tube members 20, with both the forward and intermediate tube members sliding telescopically back into the respective tube actuator assemblies 14. In the retracted state of the canopy deployment system 10, as seen in FIG. 2, the tube actuator assemblies 14 are substantially compressed with both the forward and intermediate tube members 20 and 18, respectively, being contained coaxially within the rearward outer tube 16 and therein subjected to outbound axial forces applied by respective intermediate and rearward compression springs 42 and 36, best shown in FIGS. 4 and 5 and described below. Despite the outbound spring forces applied to the forward and intermediate tube members 20 and 18, respectively, the retracted and substantially contained positions of these movable tube members within the rearward outer tube 16 are maintained by the tension of the retracted canvas 12 applied to through the forward crossbar 28. With forward rotation of the roller member 22 effected through the manual gear box 24, a gradual release of the tension of the canvas 12 allows the outbound spring forces to prevail and urge both the forward and intermediate tube members 20 and 18, respectively, outward through the rearward outer tube 16 and into their extended positions for canopy deployment.

It should be noted that a lock pin 32 along with an associated connector ring 33 and wire 33, preferably a corresponding set on each side, are provided as an additional safety feature on the present canopy deployment system 10 to be used particularly when the system is intended to be in the, fully retracted position for any extended period of time or when the canvas material, 12 is in need of repair or replacement and requires disengagement from the forward crossbar 28. Tethered via the connector wire 33 preferably on the outer side of the mounted tubular actuator assemblies 14, lock pin 32 is sized and fitted to engage a hole 16*a* radially formed in the wall of the outer tube 16 near its forward end and further engage corresponding radial holes 18*a* and 20*a* similarly formed in the intermediate and forward tube members 18 and 20, all of which holes align together in the fully retracted position of the tubular actuator assembly 14. Thus, during those times described and any other times of extended non-use, the engagement of these radial holes by the lock pin 32 on either side of the retracted tubular actuator assembly 14 will lock the assembly in place thereby ensuring the retracted positions of the assembly parts and preventing any accidental release under the spring-loaded forces applied within the chambers of the assembly.

Figure 3:
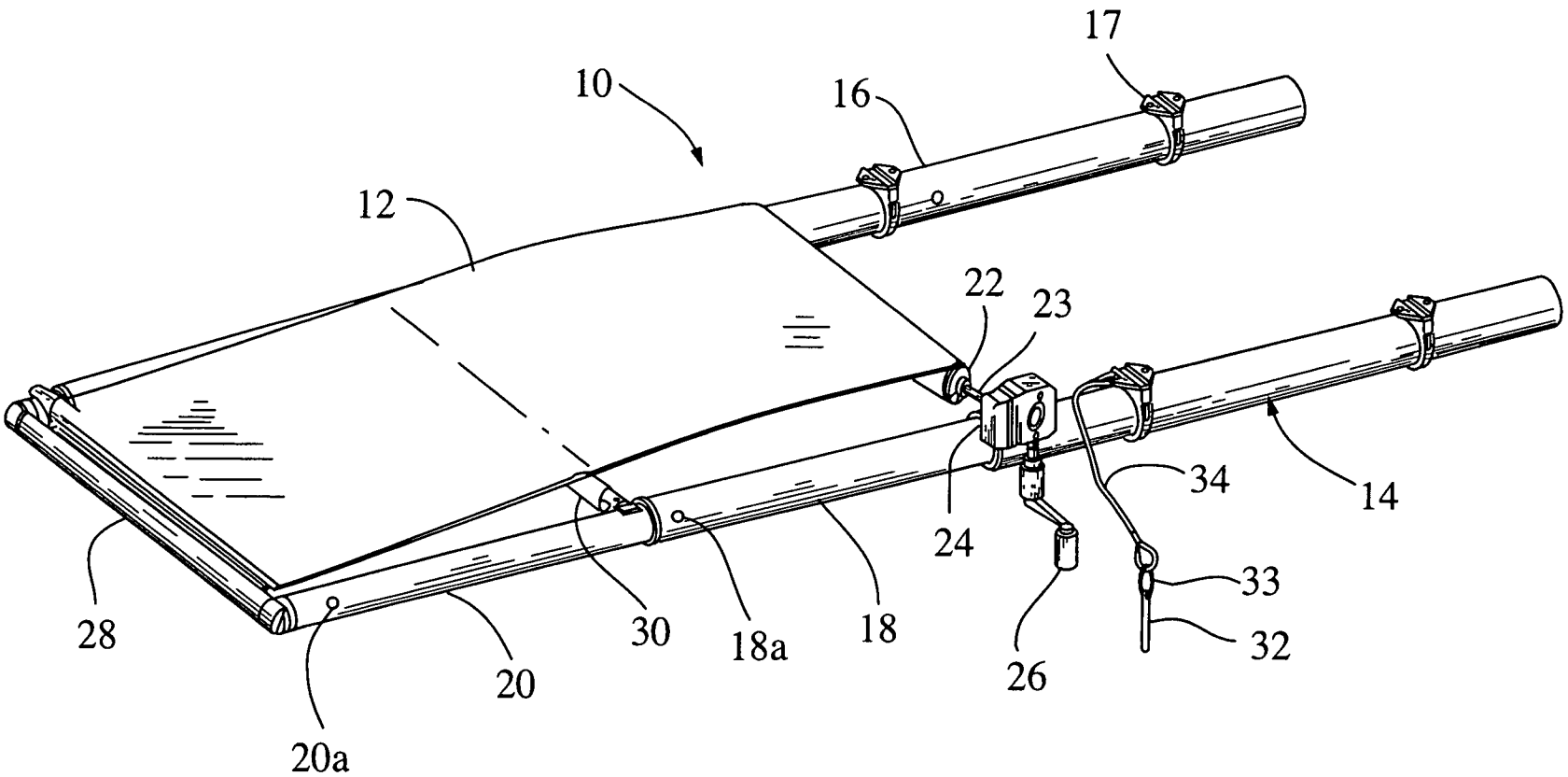
FIG. 3 is a perspective view of the extended canopy deployment system of FIG. 1 shown separated from the rooftop structure of the boat.
Figure 4:
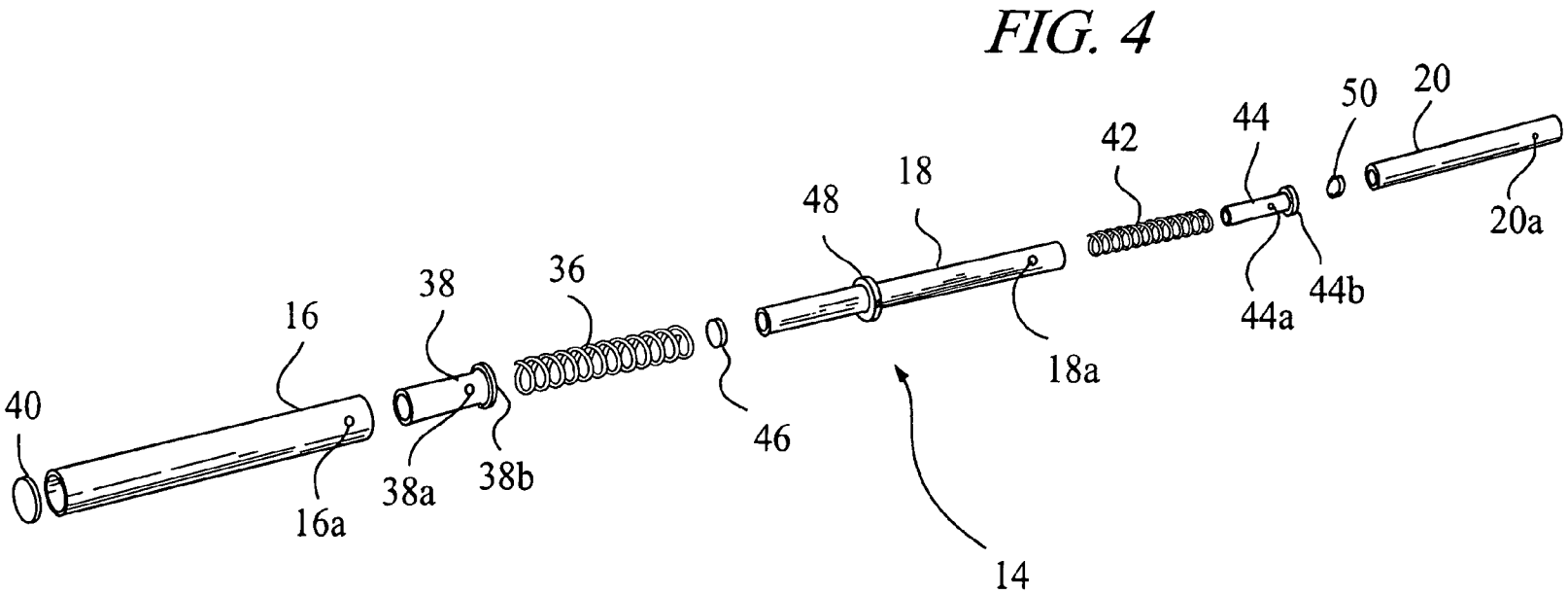
FIG. 4 is an exploded perspective view of one of the pair of tubular actuator assemblies used upon the present canopy deployment system.
Figure 5:
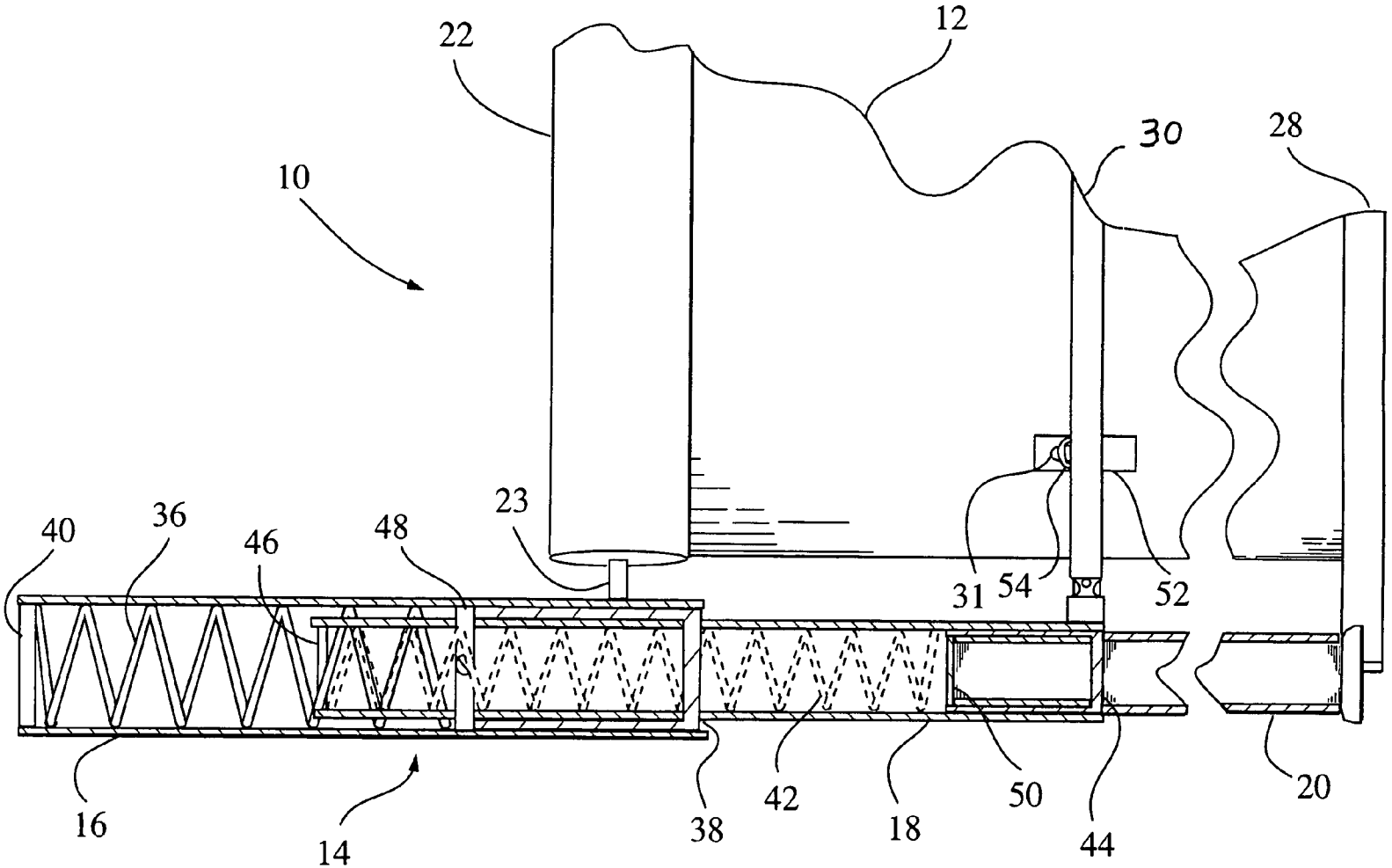
FIG. 5 is a partial plan view from below of the canopy deployment system of FIG. 3 with a cutaway showing the internal structure of the tubular actuator assembly extended on one side of the present system.

Referring now to FIGS. 3, 4 and 5, the present canopy deployment system 10 is normally urged toward full extension under constant spring pressures applied axially to the intermediate and forward tubes 18 and 20 within each of the respective actuator tube assemblies 14, with the rate and amount of the extension being controlled by a forward cranking of the manual gear box 24 and the consequent forward rotation of the roller member 22 on its shaft 23 that releases the canvas material 12 to follow the outbound movement of the forward crossbar 28. Combined with the roller member 22 and the canvas 12 thereon under tension, the gear box 28 with its reduced gear ratio normally resists the outbound spring forces of the tubular actuator assemblies 14 and prevents the actuator assemblies from extending the canopy uncontrollably. Using the handle 26, the forward cranking of the gear box 24 permits a gradual and controlled extension of the tubular actuators 14 and in connection with the roller member 22 and its associated canvas 12 disposed transversely between the actuators, further serves to synchronize both of the actuators during their extended movements.

As best seen in FIG. 4, each tubular actuator 14 is a substantially cylindrical assembly of components that fit together and move in a telescopic manner along a substantially common axis and subject to spring loading. The rearward outer tube 16 is sized in its length and diameter to fit and substantially contain forwardly in its chamber those other components of the tubular actuator assembly 14, including the intermediate tube member 18 and forward tube member 20. Intended to be closed at its back end, the outer tube 16 is fitted with a circular end cap 40 that may be fastened to the back end and secured by conventional means. As described .above and shown in FIG. 2, a small hole 16*a* formed radially in the wall of the outer tube 16 near its front end is provided to accommodate insertion by lock pin 32 when the tubular actuators 14 are fully retracted in order to lock them in place when necessary for safety purposes. An end sleeve 38, preferably made of a synthetic thermoplastic material, such as nylon, is cylindrical in form and sized to fit tightly within the front portion of the chamber of the outer tube 16. The end sleeve 38 is further formed having a small radial hole 38*a* near its front edge that aligns with hole 16*a* on the outer tube 16 and a circular rim 38*b* around the perimeter of its front edge, the rim being intended to abut firmly against and engage the front edge of the outer tube. The circular rim 38*b* and cylindrical body of the end sleeve 38 are similarly sized to allow close passage therethrough of those components of the tubular actuator assembly 14 immediately forward of the outer tube 16, particularly the intermediate tube member 18. In its form and disposition lining the front end of the chamber of the outer tube 16, the end sleeve 38 serves to guide and provide a bearing surface for the movement of the intermediate tube member 18 through the outer tube member and improves the telescoping: stability of the tubular actuator assembly 14.

The rearward compression spring 36 within each tubular actuator assembly 14 is intended to direct an appropriate axial force upon the intermediate tube member 18 urging it outbound in extension from the, stationary outer tube 16 as canvas material 12 is released from the roller, member 22 manually via the gear box 24. Rearward compression spring 36 has a standard cylindrical coil configuration, preferably formed with squared and ground ends, and is sized in its free length and outer diameter to fit the chamber of the outer tube 16 so that it may move freely within the chamber and through the inner sleeve 38. The inner diameter of the compression spring 36 is sized to fit the outside diameter of the intermediate tube member 18 which, together with an end cap 46 attached to the back end thereof, is intended for spring-loaded disposition within the actuator assembly 14 in coaxial engagement with the compression spring inside the chamber of outer tube 16. As better seen in FIG. 5, the rearward compression spring 36 is positioned within the outer tube 16 with its back end substantially square against end cap 40. A ring sleeve 48 formed to fit coaxially over the intermediate tube member 18 and slide along its outer surface is further adapted to be set and adjusted in a fixed position around the perimeter of the intermediate tube to provide a forward surface area for abutting contact with the front end of the rearward compression spring 36 and through which the axial load force of the spring 36 may be applied to the intermediate tube member. Adjustment of the position of the ring sleeve 48 forward or rearward on the intermediate tube member 18 will lessen or increase the load force applied by the rearward compression spring 36 and may be used to adjust the spring load forces and control them as needed in certain applications.

A second end sleeve 44, similar in material and form to end sleeve 38 but smaller in its diameter, is sized to fit tightly within the open front portion of the chamber of intermediate tube member 18. This second end sleeve 44 is likewise formed having a small radial hole 44*a* near its front edge that aligns with hole 18*a* on the intermediate tube member 18 for locking pin engagement and further formed with a circular rim 44*b* around the perimeter of its front edge, the rim being intended to abut firmly against and engage the front edge of the intermediate tube. The circular rim 44*b* and cylindrical body of end sleeve 44 are sized to allow close but unrestricted passage therethrough of the immediately forward tube member 20 so that it may slide telescopically back and forth through the intermediate tube member 18. Like the first described end sleeve 38, end sleeve 44, with its form and disposition lining the front end of the chamber of the intermediate tube 16, serves to guide and provide a bearing surface for the movement of the forward tube member 16 through the intermediate tube member and improves the telescoping stability of these moving members in the tubular actuator assembly 14.

The intermediate compression spring 42, like rearward spring 36 but smaller in its outer and inner diameters, is further contained within each tubular actuator assembly 14 and is designed to apply an appropriate axial force from within the chamber of the intermediate tube member 18 forwardly upon the forward tube member 20 urging it outbound into extended position as canvas material 12 is released from the roller member 22 manually via the gear box 24. Intermediate compression spring 42 has a standard cylindrical coil configuration, preferably formed with squared and ground ends, and is sized in its free length and outer diameter to fit the chamber of the intermediate tube member 18 so that it may move freely within the chamber. As best seen in FIG. 5, intermediate compression spring 42 is intended to apply its axial force forwardly from the end cap 46 at the rear of the intermediate tube member 18 and directly upon the back end of the forward .tube member 20. The intermediate compression spring 42 is positioned within the intermediate tube member 18 with its back end substantially square against end cap 46 and its front end substantially square and abutting the back end of the forward tube member 20 with an end cap 50 there attached. In this working engagement of the intermediate compression spring 42, the forward tube member 20 is urged forward and outbound from the intermediate tube member 18 by the axial force of the spring, with the movement of the forward tube member guided by end sleeve 44 and limited in its extension by the sleeve length. It is important to note that limiting the extension of the forward tube member 20 via the end sleeve 44 in this case further enhances the telescoping stability of each tubular actuator assembly 14 and improves the reliability of the present canopy deployment system 10.

For reference purposes with respect to the appropriate spring load forces required in typical operation of the present canopy deployment system 10, it is noted that a spring load of about 50 pounds developed by each of the compression springs 36 and 42 and respectively applied to the intermediate and forward tube members 18 and 20 within each of the chambers of the tubular actuator assemblies 14 is sufficient for satisfactory operation of a canopy deployment system having an approximate 6-foot extension to its tubular actuator and an 8-foot span of rolled canvas therebetween. Higher spring loads will be required in cases of longer extensions and wider spans.

Figure 6:
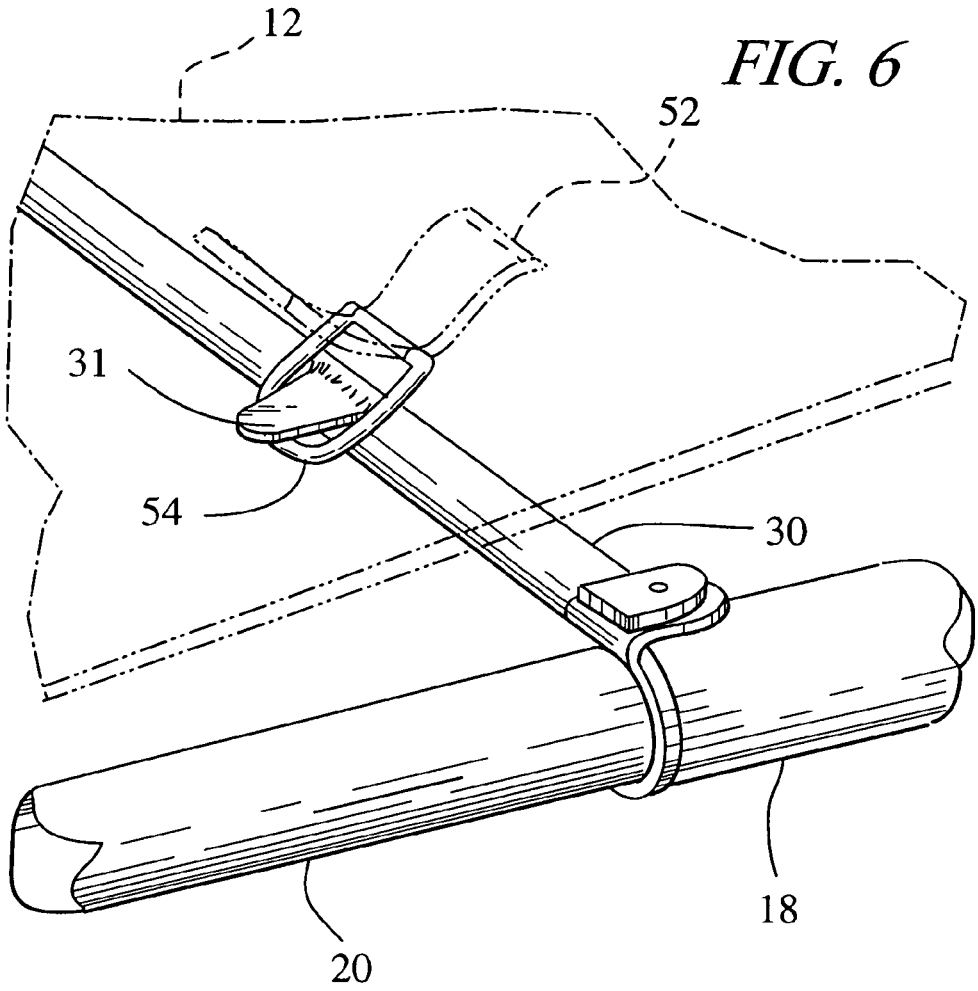
FIG. 6 is an enlarged detail view in perspective showing the intended engagement of the canvas (shown in phantom) with the intermediate cross bar upon the extended canopy deployment system of FIG. 3.

Referring now to FIG. 6 in conjunction with FIG. 5, means are further provided for in the present canopy deployment system 10 to prevent uncontrolled billowing of the canvas 12 when the system is fully extended. A fastener strip 52 of a flexible woven cloth material, the same as or similar to that of the canvas 12, is sewn or otherwise attached to the underside of the canvas sheet, preferably one strip on each side of the canvas width, with a loop member 54 made of a reinforced rope or like material secured beneath the fastener strip. Each fastener strip 52 with its associated loop member 54 is located and secured to the underside of the canvas 12 at a distance lengthwise from the outside end of the canvas (where it is releasably fastened to the forward crossbar 28 determined to be the same as the distance between the forward crossbar and intermediate crossbar 30 when the canopy deployment system 10 is fully extended. One or more tab members 31, corresponding in number to the number of fastener strips 52 and loop members 54, are formed of a rigid metallic material similar to that of the intermediate crossbar 30 and attached, typically by welding, to the top of the intermediate crossbar, the tab members being disposed in line with each of the fastener strips and loops and made to project from the intermediate crossbar in the direction of the roller member 22. In operation, as the tubular actuator assemblies 14 approach their full extension and the canvas 12 reaches full deployment upon the forward crossbar 28, the tab members 31 will engage the respective loop members 54 as they reach the intermediate crossbar 30 on the passing canvas. The tab members 31 will remain engaged with the respective loop members 54 while the canopy deployment system 10 remains fully extended thereby maintaining the extended canvas 12 in close proximity to the intermediate crossbar 30 to prevent billowing. Retraction of the canvas 12 back onto the roller member will release the tab members 31 from engagement with their corresponding loop members 55 and allow the present canopy deployment system 10 to be drawn into its retracted state.

Therefore, it is apparent that the described invention provides an improved canopy deployment system for boats that is simple to operate and easily retrofitted to existing boat structure for providing extended sunshade protection to those on board the boat without causing obstructions upon the deck. More particularly, the described invention provides a manually-operated canopy deployment system for recreational boats that is lightweight and self-supporting in its assembled structure and readily mountable to existing rooftop structure on the boat to provide extended sunshade protection whenever needed and without presenting obstructions to the movement or performance of those on or around the deck. In the disclosed embodiment for use upon recreational boats, the present manually-operated canopy deployment system may be mounted upon the surface of an existing hardtop on the boat or fully integrated within the hardtop or bridge structure atop the deck to furnish retractable sunshade protection to persons on board the boat. In addition, the disclosed boat canopy deployment system is safe and easy to use and suitable to fit virtually any style boat. Furthermore, the disclosed boat canopy deployment system is relatively inexpensive to manufacture and easy to assemble in a working unit generally affordable to a wide variety of boat owners.

Obviously, other embodiments and modifications of the present invention will readily come to those of ordinary skill in the art having the benefit of the teachings presented in the foregoing description and drawings. Alternate embodiments of different shapes and sizes, as well as substitution of known materials or those materials which may be developed at a future time to perform the same function as the present described embodiment are therefore considered to be part of the present invention. Accordingly, it is understood that this invention is not limited to the particular embodiment described, but rather is intended to cover modifications within the spirit and scope of the present invention as expressed in the appended claims.

What is claimed:

1. A retractable canopy system for manual operation in mounted attachment upon a boat structure, comprising:

a roller member adapted to rotate upon a central axis;

a sheet of canvas material fastened to said roller member and wrapped about the central axis thereof in a retracted state;

actuator means operatively connected to the boat structure for deploying said sheet of canvas material from said roller member, said actuator means including a paired set of tubular members telescopically assembled and normally contained coaxially in a retracted position subject to outbound spring loading forces to promote an extended telescopic movement and a first crossbar member forwardly mounted upon the paired set of tubular members and operatively connected to said sheet of canvas material to normally maintain tension thereon during telescopic movement of the paired set of tubular members and thereby draw the canvas from its retracted state upon a gradual release of the outbound spring loading forces upon the paired set of tubular members; and a mechanical gear box assembly mounted upon said actuator means and operatively connected to said roller member along the central axis thereof to control rotation in either direction by reducing the outbound spring loading forces applied to said roller member and gradually releasing the extended telescopic movement of the paired set of tubular members for manually controlling deployment of said sheet of canvas material.

2. A retractable canopy system according to claim 1, wherein said actuator means further comprises:

a first tubular member adapted to be mounted in a stationery position upon the boat structure, said first tubular member being closed at the back end thereof;

a second tubular member coaxially disposed immediately within said first tubular member and adapted to move telescopically therein along a substantially common axis;

a third tubular member coaxially disposed immediately within said second tubular member and adapted to move telescopically therein along a substantially common axis; and compression spring means operatively disposed within said first tubular member for applying outbound load forces axially upon the respective second and third tubular members thereby urging each forwardly from the back end of said first tubular member.

3. A retractable canopy system according to claim 2, wherein said actuator means further comprises:

a plurality of sleeve members operatively disposed between the respective tubular members at forward ends thereof to provide bearing surfaces for stabilizing telescopic movement of said tubular members.

4. A retractable canopy system according to claim 3, wherein said compression spring means comprises:

a first compression spring sized to fit longitudinally within said first tubular member and operatively disposed to apply a load force axially upon said second tubular member outward from the back end of said first tubular member; and a second compression spring sized to fit longitudinally within said second tubular member and operatively disposed to apply a load force axially upon said third tubular member outward from within said second tube member.

5. A retractable canopy system according to claim 2, wherein said actuator means further comprises:

a second crossbar member disposed rearward of said first crossbar member between the paired set of tubular members to move together therewith in support of the deployed sheet of canvas material.

6. A retractable canopy system according to claim 5, wherein:

said second crossbar member is provided with one or more tab members projecting therefrom;

and said sheet of canvas material is provided with a corresponding number of loop attachments positioned to engage respective ones of the tab members during deployment to prevent billowing of the canvas material when deployed.

7. A retractable canopy system according to claim 2, wherein said gear box assembly comprises:

a gear box unit mounted upon said first tubular member in operative connection with said roller member, said gear box unit having a reduced gear ratio sufficient to resist the outbound load forces applied upon said second and third tubular members and facilitate a controlled deployment of said canvas material; and a handle operatively connected to said gear box unit for the manual operation thereof.

8. A retractable canopy system according to claim 7, further comprising:

means operatively connected to said actuator means for locking said first, second and third tubular members together in a retracted position, said locking means comprising a pin member adapted to radially engage said first, second and third tubular members through holes formed respectively therein and aligned together when said actuator assembly is in the retracted position.

9. A retractable canopy system for manual operation upon a boat, comprising:

a roller member adapted to rotate upon a central axis;

a sheet of canvas material fastened to said roller member and wrapped about the central axis thereof in a retracted state ;

an actuator assembly operatively connected for deploying said sheet of canvas material from said roller member, said actuator assembly including a paired set of tubular members telescopically disposed and normally contained coaxially in a retracted position subject to outbound spring loading forces to promote an extended telescopic movement, a first crossbar member forwardly mounted upon the paired set of tubular members and operatively connected to said sheet of canvas material to normally maintain the retracted position of the paired set of tubular members and otherwise draw the canvas from its retracted state upon a gradual release of the extended telescopic movement of the paired set of tubular members, and a second crossbar member mounted rearward of said first crossbar member between the paired set of tubular members to move together therewith in support of the deployed sheet of canvas material;

gear box means operatively connected to said roller member along the central axis thereof to control rotation in either direction for gradually releasing the extended telescopic movement of the paired set of tubular members thereby manually controlling deployment of said sheet of canvas material; and tab means operatively connected between said sheet of canvas material and said actuator assembly for preventing said canvas material from billowing when deployed, said tab means comprising one or more tab members made to project from said second crossbar member in position to engage said canvas material during deployment.

10. A manually-operated retractable canopy system according to claim 9, further comprising:

locking means operatively connected to said actuator assembly for holding each set of tubular members together in a retracted position, said locking means comprising a pin member adapted to radially engage said first, second and third tubular members through holes formed respectively therein and aligned together when said actuator assembly is in the retracted position.

11. A manually-operated retractable canopy system according to claim 10, wherein each paired set of tubular members comprises:

a first tubular member adapted to be mounted in a stationery position upon the boat structure, said first tubular member being closed at the back end thereof;

a second tubular member coaxially disposed immediately within said outer first tubular member and adapted to move telescopically therein along a substantially common axis;

a third tubular member coaxially disposed immediately within said second tubular member and adapted to move telescopically therein along a substantially common axis; and a plurality of sleeve members operatively disposed between the respective tubular members at forward ends thereof to provide bearing surfaces for stabilizing telescopic movement of said tubular members.

12. A manually-operated retractable canopy system according to claim 11, wherein said actuator assembly further comprises:

compression spring means operatively disposed within said first tubular member for applying outbound load forces axially upon the respective second and third tubular members thereby urging each forwardly from the back end of said first tubular member.

13. A manually-operated retractable canopy system according to claim 11, wherein said gear box means comprises:

a gear box unit mounted upon said first tubular member in operative connection with said roller member, said gear box unit having a reduced gear ratio sufficient to resist the outbound load forces applied upon said second and third tubular members and facilitate a controlled deployment of said canvas material; and a handle operatively connected to said gear box unit for the manual operation thereof.

14. A manually-operated retractable canopy system according to claim 9, wherein said tab means for preventing billowing of said canvas material further comprises:

a corresponding number of loop attachments positioned upon said sheet of canvas material to engage respective ones of the tab members during deployment.

* * * * *